US010393362B2

(12) United States Patent
Wallace

(10) Patent No.: US 10,393,362 B2
(45) Date of Patent: Aug. 27, 2019

(54) ILLUMINATED HANDLE SYSTEM

(71) Applicant: Hurmie Wallace, Miami, FL (US)

(72) Inventor: Hurmie Wallace, Miami, FL (US)

( * ) Notice: Subject to any disclaimer, the term of this patent is extended or adjusted under 35 U.S.C. 154(b) by 92 days.

(21) Appl. No.: 15/822,904

(22) Filed: Nov. 27, 2017

(65) Prior Publication Data

US 2018/0149351 A1 May 31, 2018

Related U.S. Application Data

(60) Provisional application No. 62/427,514, filed on Nov. 29, 2016.

(51) Int. Cl.

| | |
|---|---|
| ***E05B 1/00*** | (2006.01) |
| ***F21V 33/00*** | (2006.01) |
| ***A47B 95/02*** | (2006.01) |
| ***F21V 23/04*** | (2006.01) |
| ***E05B 17/10*** | (2006.01) |
| *F21Y 115/10* | (2016.01) |
| *F21W 131/301* | (2006.01) |

(52) U.S. Cl.

CPC ..... *F21V 33/0024* (2013.01); *A47B 95/02* (2013.01); *E05B 17/10* (2013.01); *F21V 23/0471* (2013.01); *F21V 23/0485* (2013.01); *A47B 2220/0077* (2013.01); *E05B 1/0015* (2013.01); *F21W 2131/301* (2013.01); *F21Y 2115/10* (2016.08)

(58) Field of Classification Search

CPC ..... F21V 33/0024; F21V 23/0471; F21V 23/0485; F21V 33/0004; F21V 33/0012; F21V 33/0016; A47B 95/02; A47B 2220/0077; E05B 17/10; E05B 1/0015; F21Y 2115/10; F21W 2131/301

See application file for complete search history.

(56) References Cited

U.S. PATENT DOCUMENTS

| | | | | |
|---|---|---|---|---|
| 5,450,299 A * | 9/1995 | Lepre | E04F 11/1804 362/145 |
| 5,909,955 A | 6/1999 | Roorda | |
| 6,672,552 B1 * | 1/2004 | Jao | A46B 15/0087 248/251 |
| 7,967,468 B2 | 6/2011 | Levine | |

(Continued)

*Primary Examiner* — Bao Q Truong
(74) *Attorney, Agent, or Firm* — Global Intellectual Property Agency, LLC; Daniel Boudwin

(57) ABSTRACT

The present invention provides an illuminated handle system for a cabinet. The illuminated handle system includes at least one handle comprising a gripping member, at least one support member that secures to a cabinet door via a fastener, a light source disposed within the gripping member, wherein the light source is operably connected to a first power source, a microprocessor, and a first transceiver. The microprocessor actuates the light source when a wireless signal is received by the first transceiver. The illuminated handle system further includes a motion sensor comprising a housing having a second power source and a second transceiver, wherein the motion sensor transmits a wireless signal to the handle when motion is detected, such that the light source is actuated. In an alternative embodiment, the light source is operably connected to a temperature activated sensor disposed within the handle that actuates the light source.

7 Claims, 4 Drawing Sheets

(56) References Cited

U.S. PATENT DOCUMENTS

| | | | | |
|---|---|---|---|---|
| 2013/0021787 | A1 | 1/2013 | Noble | |
| 2013/0147368 | A1 | 6/2013 | McCavit et al. | |
| 2018/0099610 | A1* | 4/2018 | Meyers ..... | B60Q 1/0076 |

* cited by examiner

ILLUMINATED HANDLE SYSTEM

CROSS REFERENCE TO RELATED APPLICATION

This application claims the benefit of U.S. Provisional Application No. 62/427,514 filed on Nov. 29, 2016. The above identified patent application is herein incorporated by reference in its entirety to provide continuity of disclosure.

BACKGROUND OF THE INVENTION

The present invention relates to illuminated handles. More specifically, the present invention provides an illuminated handle system for a cabinet door. The illuminated handle system includes at least one handle and a motion detector for actuating the light source within the cabinet handle. The handle may further include a temperature activated sensor within the handle that illuminates the light source when heat is detected.

Many people walk about a house during the night in order to use the bathroom or obtain an item from the kitchen. In many instances, a person will refrain from turning on lights to prevent waking another person sleeping within the home or to avert bright lights from shining in their eyes. In such situations, the person may stumble while trying to make their way through the bathroom or kitchen because of the lack of light. Therefore, there exists a need for an illuminated handle system that replaces conventional cabinet handles to provide a limited amount of light when roaming a house in darkness.

Devices have been disclosed in the known art that relate to illuminated handles. These include devices that have been patented and published in patent application publications. These devices mostly relate to illuminated handles for purses or buckets. Generally, these devices are secured to a strap or handle and used to direct light into a dark recess, such as an opening of a pursue. Other similar devices include puck style lighting devices that attach under a cabinet in order to provide dim lighting. Some devices include a light detection or motion sensor within the device that is used to actuate the light source.

However, these known art devices have several drawbacks. The devices fail to include a light source that is disposed within a cabinet door handle. Furthermore, these devices fail to disclose a separate motion sensor that is disposed within a proximity of the handle that can wirelessly activate the light source when motion is detected. Lastly, none of these devices include temperature activated sensors that can further actuate the light of the device when body heat is detected.

In light of the devices disclosed in the known art, it is submitted that the present invention substantially diverges in design elements from the known art and consequently it is clear that there is a need in the art for an improvement to existing illuminated handle devices. In this regard the instant invention substantially fulfills these needs.

SUMMARY OF THE INVENTION

In view of the foregoing disadvantages inherent in the known types of illuminated handles now present in the known art, the present invention provides a new illuminated handle system wherein the same can be utilized for providing convenience for the user when illuminating cabinet handles in a dark space.

It is therefore an object of the present invention to provide a new and improved illuminated handle system that has all of the advantages of the known art and none of the disadvantages.

It is another object of the present invention to provide an illuminated handle system including at least one handle comprising a gripping member having an interior volume, at least one support member configured to secure to a cabinet door via a fastener, a light source disposed within the gripping member, wherein the light source is operably connected to a first power source, a microprocessor operably connected to the light source, and a first transceiver operably connected to the microprocessor. The illuminated handle system further includes a motion sensor comprising a separate housing having a second power source and a second transceiver, wherein the motion sensor is configured to transmit a wireless signal to the handle when motion is detected, such that the light source is actuated.

Another object of the present invention is to provide an illuminated handle system, wherein the handle further comprises a temperature activated sensor configured to actuate the light when heat is detected, allowing a user to manually activate the light via heat sensed from their touch. Alternatively, the light source may be further configured to actuate when body heat is detected when a user is near the handle.

Yet another object of the present invention is to provide an illuminated handle system, wherein the light source comprises a plurality of light emitting diodes.

Another object of the present invention is to provide an illuminated handle system that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
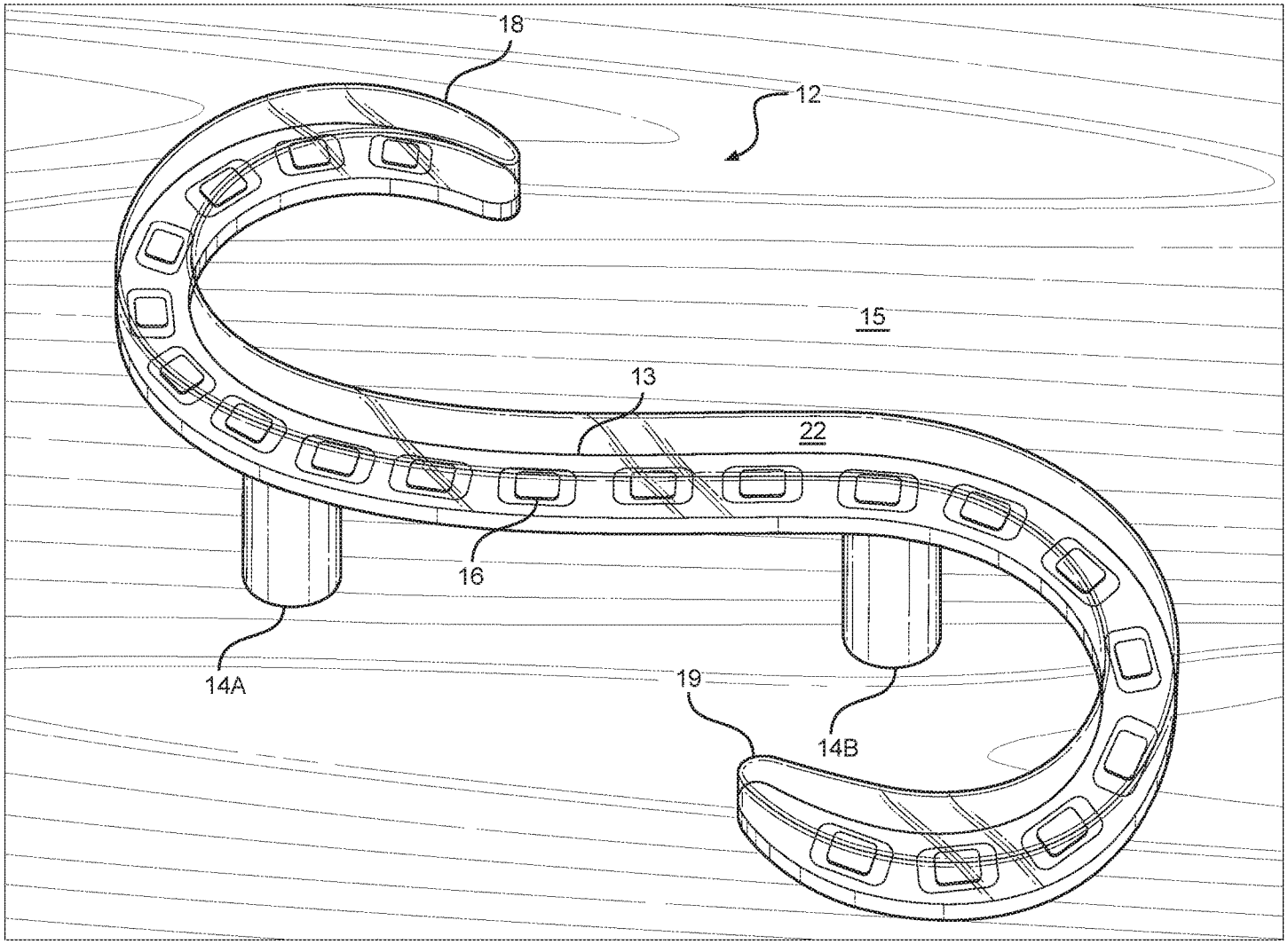
FIG. 1 shows a perspective view of an embodiment of a handle of the illuminated handle system.

Reference is made herein to the attached drawings. Like reference numerals are used throughout the drawings to depict like or similar elements of the illuminated handle system. For the purposes of presenting a brief and clear description of the present invention, the preferred embodiment will be discussed as used for illuminating kitchen cabinet handles by means of a separate detached motion detection sensor. In an alternative embodiment, the handle further includes a temperature activated sensor that allows a user to illuminate the handle manually by heat sensed through touch or from body heat within a proximity to the handle. The figures are intended for representative purposes only and should not be considered to be limiting in any respect.

Referring now to FIG. 1 there is shown a perspective view of an embodiment of a handle of the illuminated handle system. The illuminated handle system comprises at least one handle 12 having a gripping member 13 and at least one support member 14A, 14B configured to secure to a surface 15 of a cabinet door via a fastener. The fastener may be any type of fastener, such as a screw or an adhesive. In the illustrated embodiment, the gripping member 13 includes a first support member 14A and a second support member 14B. However, in alternative embodiments, the handle 12 may only include one support member 14 to accommodate various cabinet handles styles.

The handle 12 further includes at least one light source 16 disposed within an interior volume of the gripping member 13, wherein the light source 16 is operably connected to a first power source. In the illustrated embodiment, the light source 16 comprises a plurality of light emitting diodes (LEDs) disposed along the interior volume of the gripping member 13. However, any suitable light may be used as the light source 16. The plurality of LEDs are disposed such that the lights are positioned from a first end 18 of the handle to the second end 19. Further, each light is centrally disposed between the lateral sides of the handle. The gripping member 16 further includes an upper surface 22 that allows light from an actuated light source 16 to shine therethrough. In some embodiments, an upper surface of the light source is flush with the upper surface 22 of the gripping member such that a continuous surface 22 is formed. In the shown embodiment, the entire surface 22 is transparent. This configuration provides an increased illuminated surface that provides more lighting during the night time. However, in alternative embodiments, the transparent surface 22 may have less exposed surface area to vary the amount of light emitted from the handle 12.

In the illustrated embodiment, the handle 12 has a S shape configuration. However, in alternative embodiments, the handle 12 may be configured as any suitable shape that is adapted to be grasped by a user to open a cabinet door, such as, circular, rectangular, figure eight, or cylindrical. In further embodiments, the handle 12 comprises an intricate design shape, such as, a flower that includes an indicia or logo. This design provides a more aesthetically appealing cabinet handle 12 that can provide various illumination patterns when the light source 16 is actuated.

Figure 2:
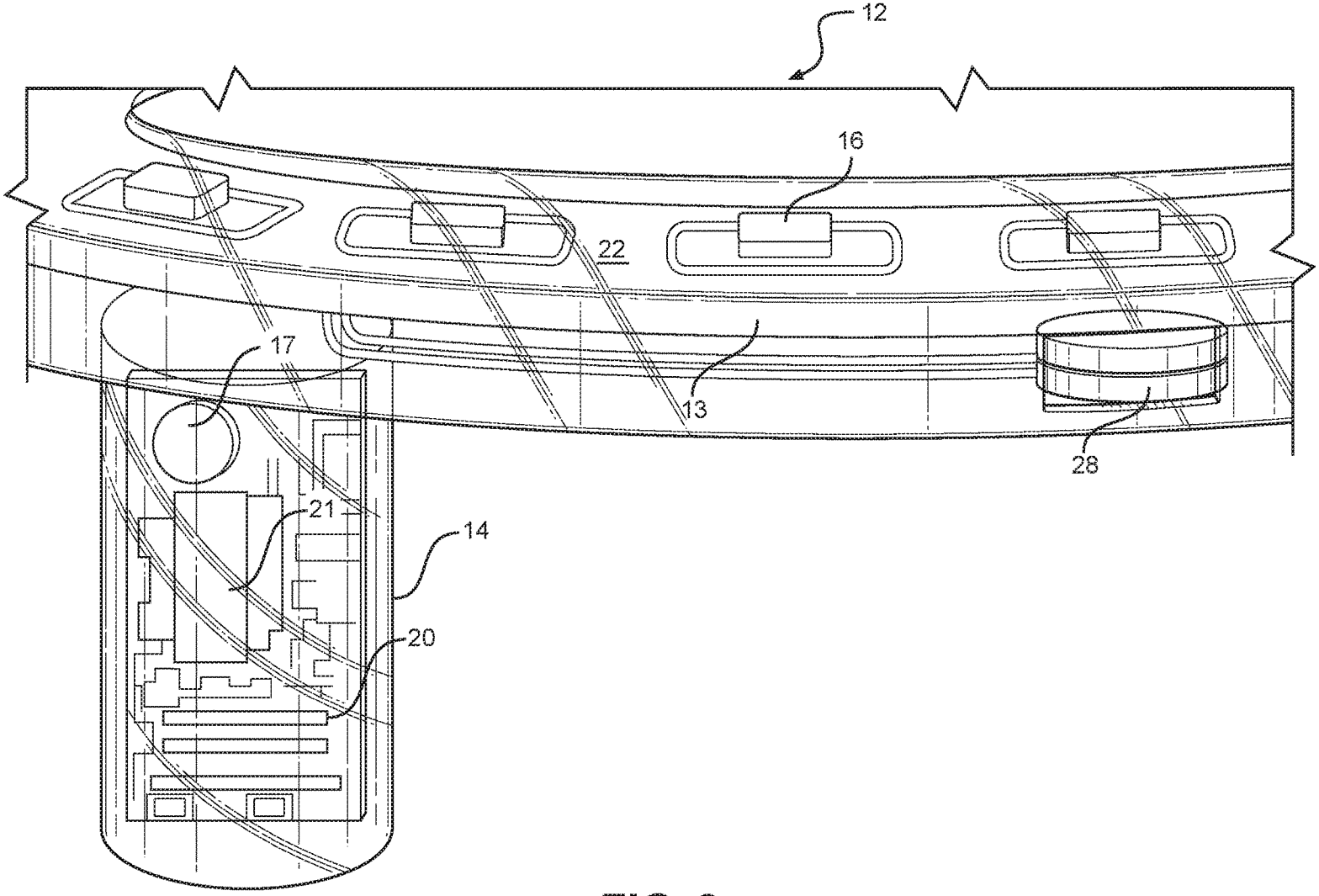
FIG. 2 shows a close up view of an embodiment of a support member of the illuminated handle system.

Referring now to FIG. 2, there is shown a close up view of an embodiment of a support member of illuminated handle system. The handle 12 of the illuminated handle system further includes a microprocessor 20 and a first transceiver 21 that are operably connected to both the light source 16 and the first power source 17. The first power source 17 can be any suitable power source, such as a battery or a hardwired electrical connection. In the illustrated embodiment, the first power source 17, the microprocessor 20, and first transceiver 21 are housed within the support member 14 of the handle 12. However, each of these components may be housed anywhere within the handle 12, such as within the interior volume of the gripping member 13. The first transceiver 21 is configured to wirelessly communicate with a second transceiver disposed in a separate motion sensor placed within a proximity of the handle 12. The motion sensor is configured to transmit a signal to the handle 12 to actuate the light source 16 when motion is detected. This allows a user to actuate the handle lights simply by walking within the range of the motion sensor. The range of the motion sensor can be varied for use based on the room size. Further, the microprocessor 20 is configured to deactivate the light source 16 after a pre-determined amount of time if motion is no longer detected.

In the illustrated embodiment, the handle 12 further comprises a temperature activated sensor 28 disposed within the gripping member 13. The sensor 28 is operably connected to the microprocessor 20, such that when the sensor 28 detects heat from a nearby user, such as body heat or heat from the hand of a user, the microprocessor 20 actuates the light source 16 within the gripping member 13. In this way, a user can manually activate the light source 16 within the handle 12 by touching the sensor 28 or by simply walking within a proximity of the sensor 28. This allows the handle to be activated without the use of a separate motion sensor. The proximity can be varied based on the range of heat detection of the sensor. In an alternative embodiment, the sensor 28 may be configured as a light detecting sensor, wherein the light source 16 is actuated when there is a lack of visible light. In this way, the light source 16 will actuate during the night time, and deactivate during the day time.

Figure 3:
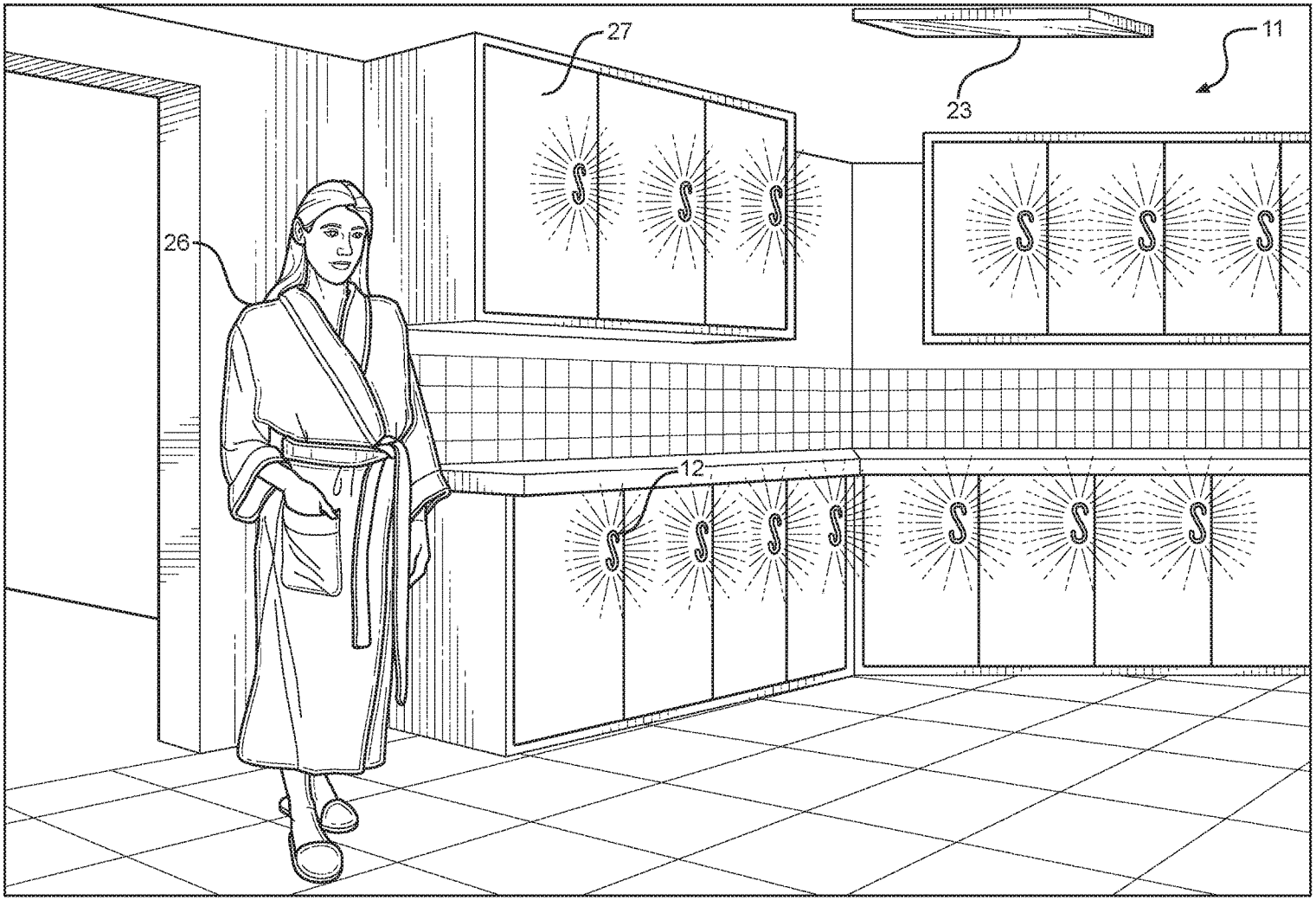
FIG. 3 shows a perspective view of an embodiment of the illuminated handle system in use.
Figure 4:
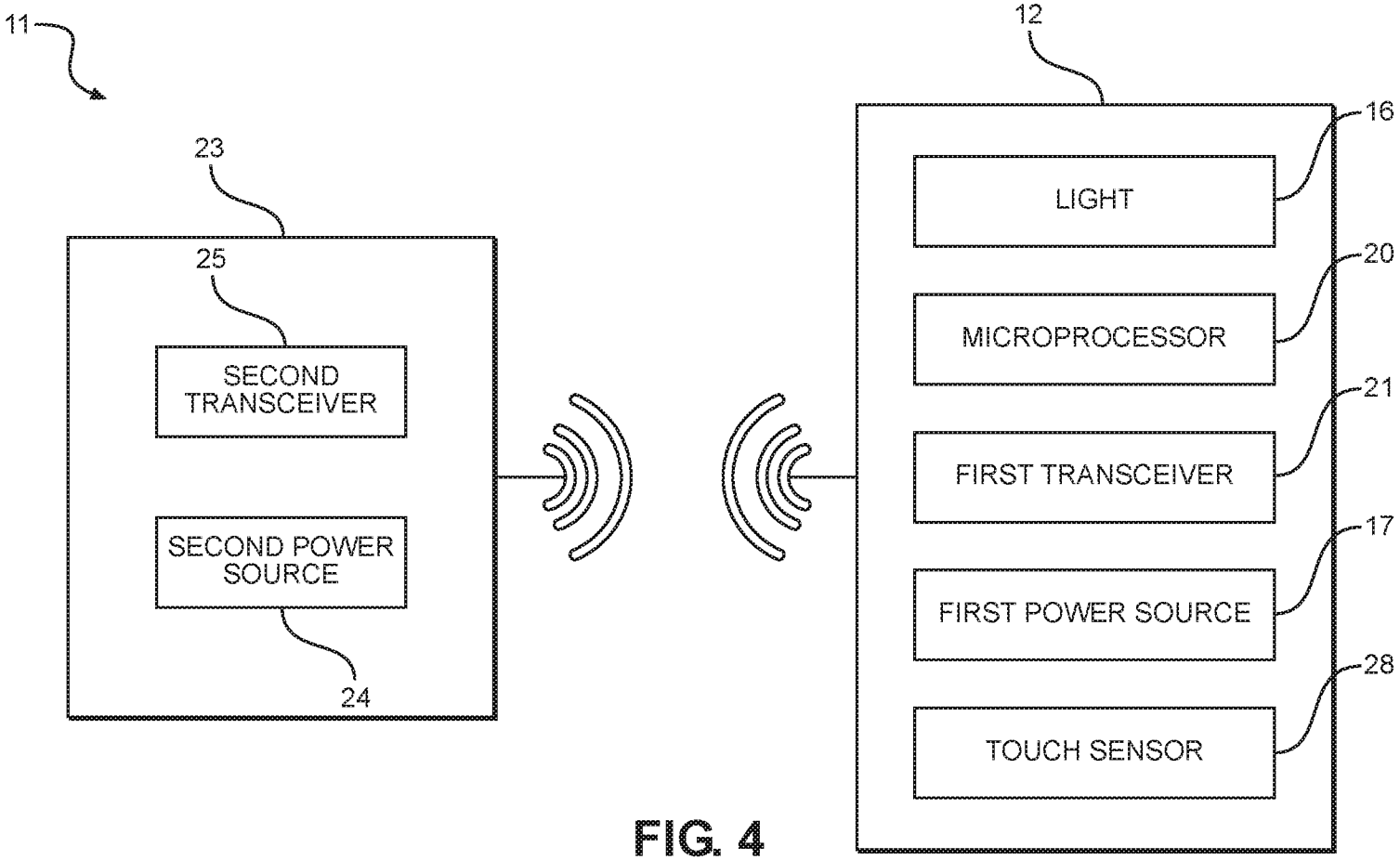
FIG. 4 shows a diagram of an embodiment of the illuminated handle system.

Referring now to FIGS. 3 and 4, there is shown a perspective view of an embodiment of the illuminated handle system in use and a diagram of an embodiment of the illuminated handle system, respectively. The illuminated handle system 11 further comprises a motion sensor 23 that is wirelessly connected to the handle 12. The motion sensor is designed to be placed within a proximity of the handle 12 such that the handle 12 receives a wireless signal therefrom. The motion sensor 23 includes a second power source 24 and a second transceiver 25 that are operably connected thereto, wherein the second transceiver 25 is configured to transmit a signal to the first transceiver 21 of the handle 12 when motion is detected by the motion sensor 23. Once the transmitted signal is received by the first transceiver 21, the microprocessor 20 within the handle is configured to actuate the light 16 of the handle.

In the illustrated embodiment, the illuminated handle system 11 includes multiple handles 12 disposed on each cabinet 27 within a room, such as the kitchen. The motion sensor 23 is configured to wirelessly send a signal to each of the handles 12 via the second transceiver 25. In this way, when a user 26 enters the room, motion is detected thereby actuating the light 16 of each handle 12. The lights within the handles 12 illuminate the space allowing the user 26 to easily make their way through the room. Depending on the illumination preference of the user 26, handles 12 can be selected that have various ranges of illumination, such as brighter for a kitchen and dimmer for a bathroom.

In the illustrated embodiment, the motion sensor 23 is disposed on the ceiling within the room. In alternative embodiments, the housing of motion sensor 23 may be configured as an overhead light. In the shown embodiment, the housing of the motion sensor 23 has a rectangular shape. However, in alternative embodiments the motion sensor 23 can be any suitable shape, such as curved, circular, or square. In some embodiments, the second power source 24 of the motion sensor 23 is a battery, configured to allow the motion sensor 23 to be portably secured to any surface. However, in alternative embodiments the second power source 24 is hard wired to an electrical system. This allows the motion sensor 23 to continuously operate without the need to change a drained battery. If the second power source 24 within the motion sensor is configured as a battery and becomes drained, the handle remains operable because of the additional sensor 28. This sensor 28 will still actuate the light when sensing heat from touch or proximity.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminated handle system for a cabinet, comprising:

a handle comprising:

a gripping member having an interior volume;

at least one support member configured to secure to a cabinet door via a fastener;

a light source disposed within the gripping member, wherein the light source is operably connected to a first power source;

a microprocessor operably connected to the light source, wherein the microprocessor is configured to actuate the light source;

a first transceiver operably connected to the microprocessor, configured to receive a wirelessly transmitted signal;

a motion sensor comprising a housing having a second power source and a second transceiver, wherein the motion sensor is configured to transmit a wireless signal to the first transceiver disposed within the handle when motion is detected.

2. The illuminated handle system of claim 1, wherein the handle further comprises a sensor configured to actuate the light.

3. The illuminated handle system of claim 2, wherein the sensor is a temperature activated sensor configured to sense heat.

4. The illuminated handle system of claim 2, wherein the sensor is a light sensor configured to sense light.

5. The illuminated handle system of claim 1, wherein the light source is a plurality of light emitting diodes (LEDs).

6. The illuminated handle system of claim 1, wherein an upper surface of the gripping member is transparent.

7. The illuminated handle system of claim 1, wherein the light source is centrally disposed between lateral sides of the gripping member.

* * * * *